US006199335B1

(12) United States Patent
Brenot et al.

(10) Patent No.: US 6,199,335 B1
(45) **Date of Patent: *Mar. 13, 2001**

(54) FLOOR STRUCTURE FOR USE ON ICE AND THE METHOD OF USING THE SAME

(75) Inventors: Stephen E. Brenot, Fergus Falls, MN (US); Arnold G. Althoff, Hankinson; Randy M. Schneider, Fargo, both of ND (US)

(73) Assignee: SpaceAge Synthetics, Inc., Fargo, ND (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,890

(22) Filed: Sep. 8, 1998

(51) Int. Cl.[7] ..... E04B 5/43

(52) U.S. Cl. ..... 52/480; 52/177; 52/180; 472/90; 472/92

(58) Field of Search ..... 52/177, 180, 6, 52/480, 592.1, 566.1, 731.3, 732.2, 650.3, 100; 428/116, 118, 179, 180, 913; 472/88, 90, 92; 404/35, 36, 41; 108/13

(56) References Cited

U.S. PATENT DOCUMENTS

| | | | | |
|---|---|---|---|---|
| D. 232,895 | * | 9/1974 | Bell . | |
| 2,653,525 | * | 9/1953 | McGuire . | |
| 3,909,996 | * | 10/1975 | Ettlinger, Jr. et al. | 52/177 |
| 4,030,729 | * | 6/1977 | Nathaniel | 272/3 |
| 4,169,688 | * | 10/1979 | Toshio | 404/40 |
| 4,860,510 | * | 8/1989 | Kotler | 52/177 |
| 5,204,159 | * | 4/1993 | Tan | 428/143 |
| 5,303,526 | * | 4/1994 | Niese | 52/393 |
| 5,456,966 | * | 10/1995 | Austin | 428/120 |
| 5,619,832 | * | 4/1997 | Myrvold | 52/403.1 |
| 5,637,378 | * | 6/1997 | Hensler et al. | 428/192 |
| 5,771,706 | * | 6/1998 | Lavinge | 52/235 |
| 5,815,995 | * | 10/1998 | Adam | 52/177 |
| 5,820,470 | * | 10/1998 | Saunders | 472/92 |
| 5,820,798 | * | 10/1998 | Staten et al. | 264/45.5 |
| 5,833,386 | * | 11/1998 | Rosan et al. | 404/36 |
| 5,983,584 | * | 11/1999 | Staten et al. | 52/309.8 |
| 6,032,428 | * | 3/2000 | Rosan et al. | 52/592.1 |
| 6,044,606 | * | 4/2000 | Hamar | 52/403.1 |

* cited by examiner

*Primary Examiner*—Carl D. Friedman
*Assistant Examiner*—Yvonne M. Horton

(57) ABSTRACT

A floor structure for use on an ice surface includes sheets of rigid, lightweight material each having a topside and a bottom side which includes a margin and geometric recesses and recess dividers. Only the margins and recess dividers are in contact with the ice surface when this floor structure is laid upon the ice. The recess dividers effectively seal the geometric recesses creating sealed pockets which trap ambient air thus creating a thermal insulating effect which substantially prevents the coldness from the ice from penetrating the sheets to the topsides and prevents condensation from forming on the topsides making it safe for the users to move about upon this floor structure unlike other floor structures which are used on ice. In addition, this floor structure does not stick or freeze to the ice unlike the other floor structures, because it has a substantially smaller surface area which is in direct contact with the ice, making it much easier to remove and reuse.

46 Claims, 4 Drawing Sheets

FLOOR STRUCTURE FOR USE ON ICE AND THE METHOD OF USING THE SAME

BACKGROUND OF THE INVENTION

This invention relates to a floor structure for use on ice and the method of using the same which allows the use of ice rinks for purposes other than just for ice skating without the ice ever having to be melted.

Ice rinks either indoors or outdoors are a common sight and in most cases are set up year round for recreational purposes. It would be cost prohibited either if the arenas all were set up with ice rinks and could not be used for anything else or the ice in the arenas would have to be melted in order for the arenas to be used for some other types of events and then the ice rinks would have to be reformed after the other types of events were finished. To avoid having to do the latter each time, most operators of the arenas have used flat boards such as plywood and simply wood-like portable floors such as is commonly seen for basketball floors which are foldable wood-like floors having flat bottom sides and which are laid out upon the ice. The problems with these types of floors are that (1) they don't have any kind of insulation and as a result, the coldness from the ice penetrates through the floors and causes condensation to form on the top sides of the floors making the floors essentially slippery and dangerous and unusable, and also (2) they tend to stick to the ice making it very hard to remove after use. However, the present invention overcomes all of these problems.

SUMMARY OF THE INVENTION

The present invention relates to a floor structure for use on ice and the method of using the same includes a plurality of sheets of substantially rigid lightweight material each of which includes a generally flat, smooth topside capable of being walked upon by users and a bottom side having a generally flat, uniform border extending at the edge thereof and a plurality of geometric recesses each of which are tapered in depth or has side walls which are tapered inwardly to provide added strength and stability to the sheets. Each of the geometric recesses has a particular geometric shape such as a square, rectangle, and circle. The geometric recesses are arranged in a waffle-like pattern between the margin and with a plurality of recess dividers separating the geometric recesses. The sheets also have thermal insulation properties. These sheets of rigid material are placed on the ice surface with the recess dividers and the flat margins of the bottom sides resting essentially flush upon the ice surface, and are engageably placed side-by-side to form a floor structure. Ambient air is trapped inside the recesses between the ice and the sheets of material thus creating an thermal insulating means.

One objective of the present invention is to provide a floor structure for use on ice which has insulating means and prevents the coldness from penetrating through the floor structure and causing condensation to form on the topside or access side of the floor structure.

Another objective of the present invention is to provide a floor structure for use on ice which can be conveniently and quickly placed upon the ice and then be easily and quickly removed from the ice after use without the floor structure having been stuck to the ice.

Further objectives and advantages of the present invention will become apparent as the description proceeds and when taken in conjunction with the accompanying drawings wherein:

DETAILED DESCRIPTION OF THE INVENTION

Figure 1:
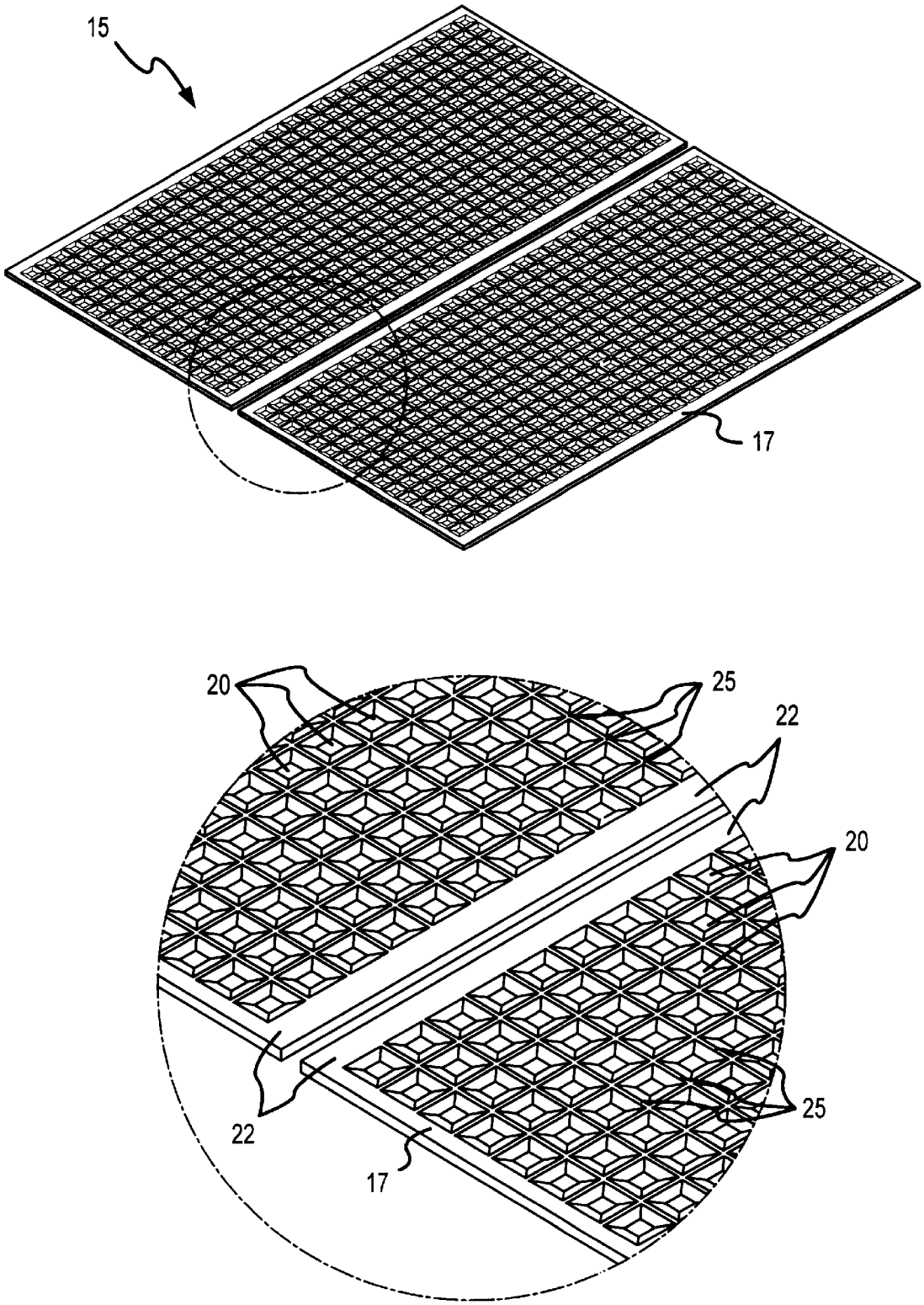
FIG. 1 is a bottom perspective view of the floor structure for use on ice.
Figure 2:
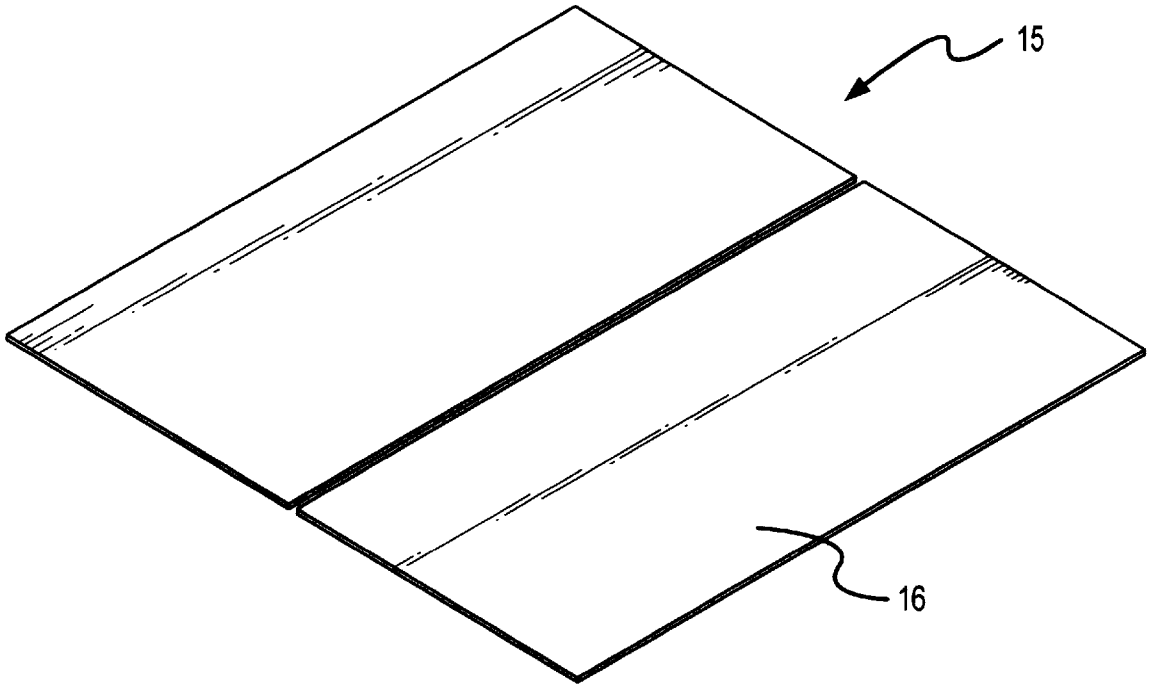
FIG. 2 is a top perspective view of the floor structure for use on ice.
Figure 3:
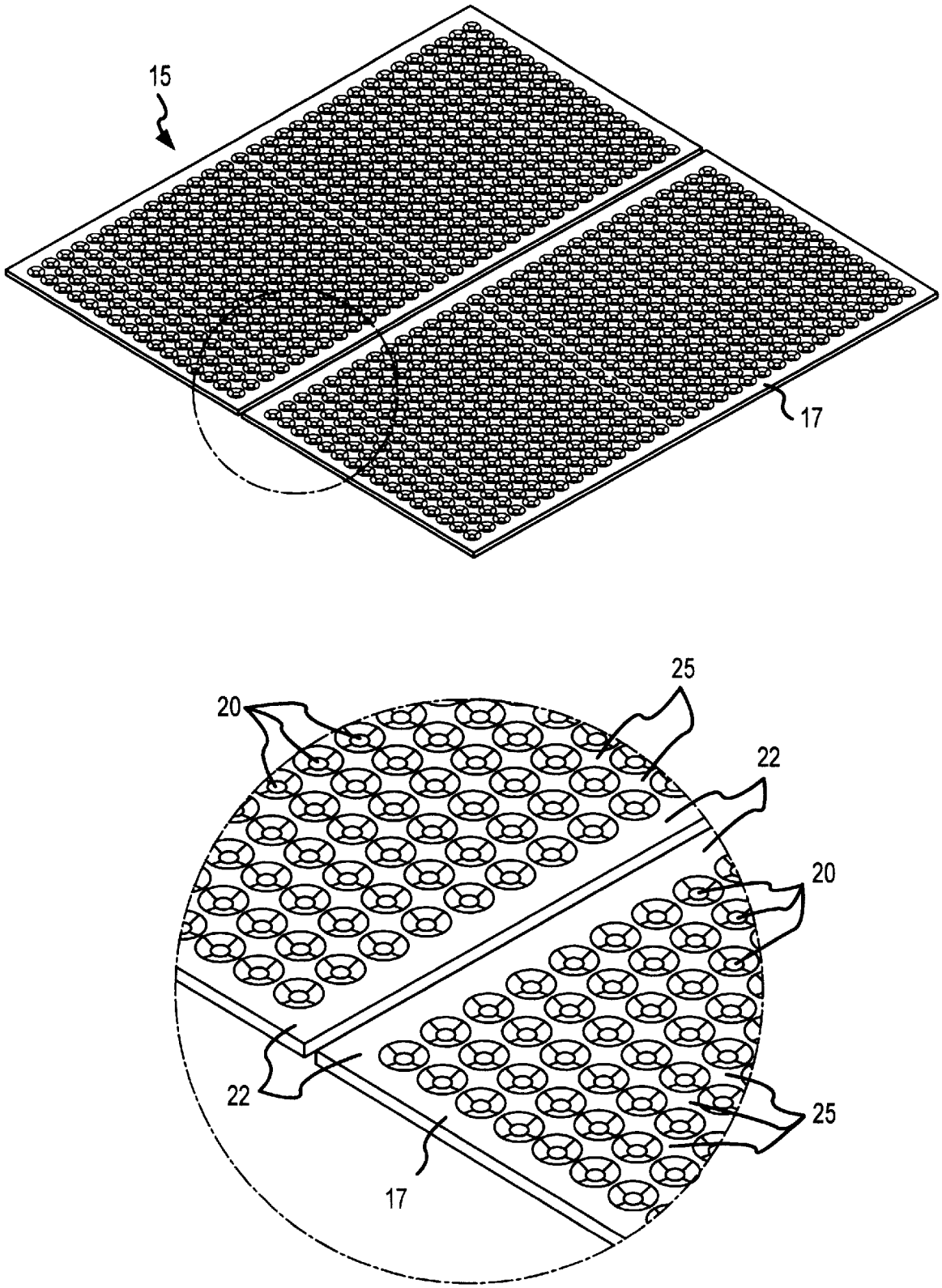
FIG. 3 is a bottom perspective view of another embodiment of the floor structure for use on ice.
Figure 4:
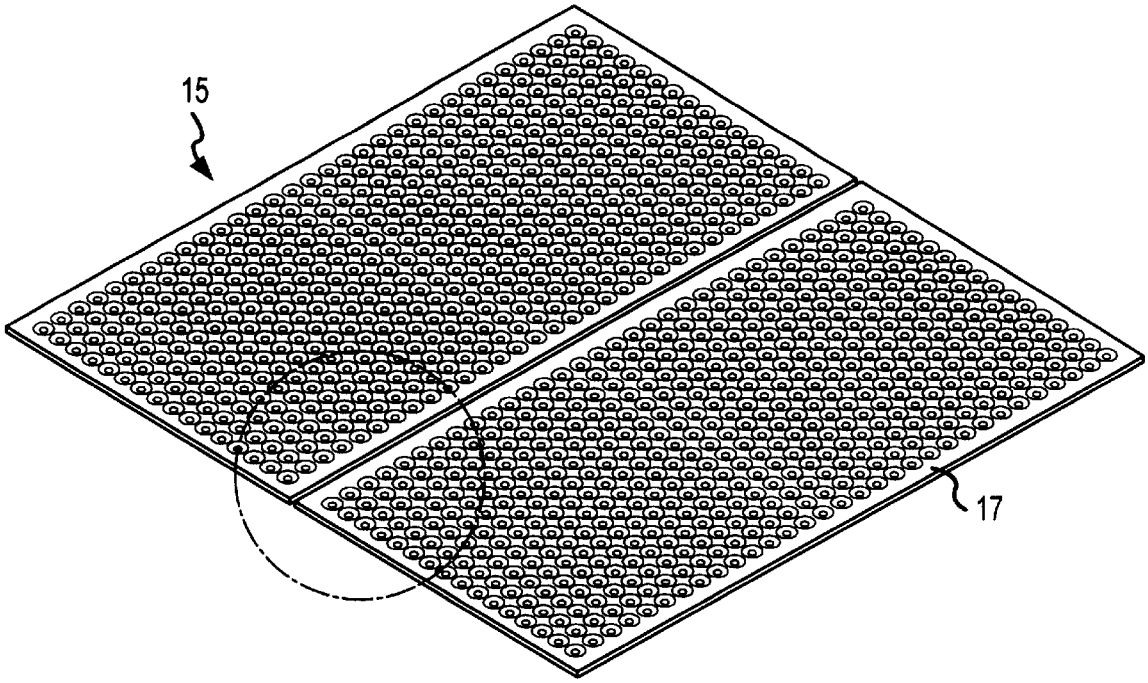
FIG. 4 is a bottom perspective view of yet another embodiment of the floor structure for use on ice.
Figure 4:
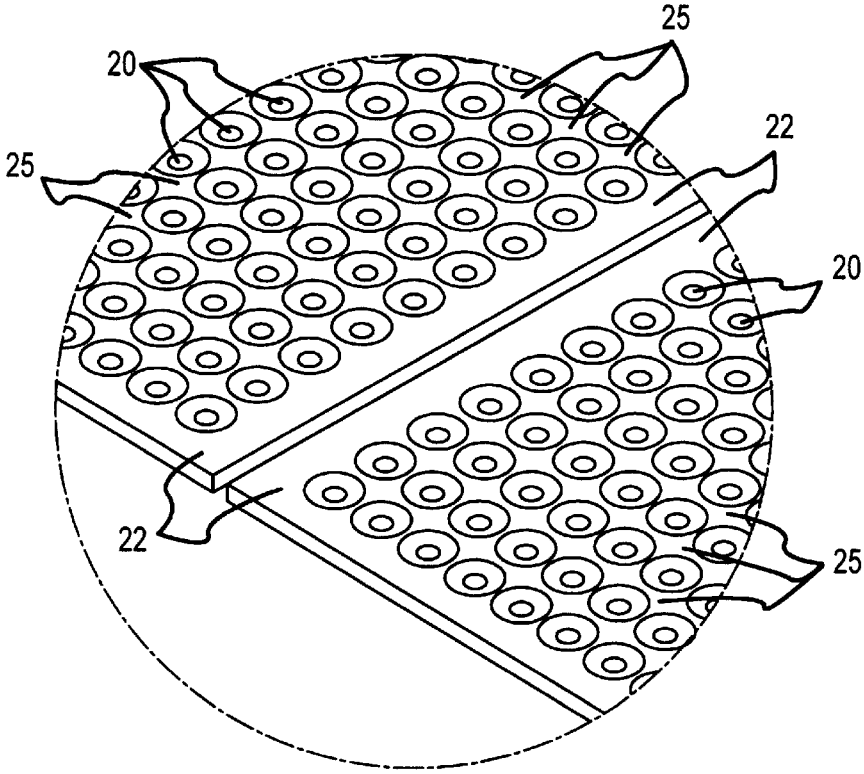

Referring to the drawings in FIGS. 1–3, in particular, the floor structure for use on ice and the method of forming the same comprises a plurality of sheets 15 of rigid lightweight material each of which preferably has a predetermined thickness of approximately one inch but the thickness can vary depending upon the need. Each of these sheets 15 has an essentially flat, smooth topside 16 or user access side capable of being moved about upon and further has a bottom side 17 having an essentially flat uniform margin 22 of a pre-determined width extending along the edge thereof and further having a plurality of geometric recesses 20 arranged in an essentially waffle-like pattern such that the geometric recesses 20 are arranged side-by-side and end-to-end with a plurality of the geometric recesses 20 having at least one side adjoining the margin 22. All other geometric recesses 20 have sides and ends which essentially adjoin the sides and ends of the other geometric recesses 20. A plurality of recess dividers 25 or grid-like members essentially extend between the geometric recesses 20. Each of the geometric recesses 20 are tapered in depth with each side of the recesses 20 being tapered inwardly to add strength and stability to the sheets 15. Each of the recesses 20 has a depth of approximately one inch but this depth may vary depending upon the need. The geometric recesses 20 in combination with the ice surface effectively form sealed pockets which effectively encapsulates and traps the ambient air to substantially effect a thermal insulating means which prevents the coldness including the cold air caused by the ice from penetrating through the sheets 15 and forming condensation on the topsides 16 thereof. In addition to these thermal insulating means effected by the sealed pockets in combination with the ambient air, each sheet has additional thermal insulating properties effected by certain thermal insulating materials including polyurethane foam to further prevent the coldness from penetrating the sheet and causing the topside 16 to become slippery. These sheets 15 are not intended to be used as permanent floors on the ice but are intended to be used as temporary floors which must be constructed for easy and convenient handling by the operators who set up the sheets 15 upon the ice to form a floor structure. Preferably, for easy handling, the sheets 15 are approximately four feet wide and eight feet long but the sheets 15 can have different sizes depending upon the situation and need. Further, the sheets 15 are preferably one inch thick but again, the thickness can vary depending upon the need.

To form the floor structure, the user places the sheets 15 upon the ice surface with the bottom side 17 facing the ice surface and the recess dividers 25 and the margins 22 on the bottom sides of the sheets 15 resting essentially flush upon the ice. The sheets 15 are arranged side-by-side and end-to-end and covers as much of the ice surface as desired by the operator. To keep the sheets 15 essentially together, conventional fastening means are used. Only the margins 22 and the recess dividers 25 come into contact with the ice and effectively seal the geometric recesses 20 essentially trapping ambient air therein. These sheets 15 have a very small amount of surface area which is in contact or engaged with the ice unlike other types of sheets such as plywood of which are commonly used for flooring on ice. Because of this small surface area, these sheets 15 do not freeze nor stick to the ice unlike sheets of plywood. Further, when these sheets 15 are placed upon the ice surface, the geometric recesses 20 in combination with the ice form sealed pockets which trap ambient air thus creating a thermal insulating means. Any coldness emanating from the ice is effectively prevented from penetrating through the sheets 15 because of this thermal insulating means comprising trapped ambient air which acts as a barrier. To further enhance their insulating effects, these sheets 15 are made from material such as polyurethane foam which have thermal insulating properties. Substantially no coldness from the ice penetrates these sheets 15 to the topsides 16 thereof. Thus the topsides 16 of these sheets 15 remain dry and substantially warmer than if the sheets were made of plywood. Thus making it safe for the users to walk or move thereupon. When this floor structure isn't needed anymore, the conventional fastening means are easily removed and each sheet picked up off the ice surface with little or no difficulty. Because of the lack of surface area being in contact with the ice, these sheets 15 do not stick to the ice surface, and since they are lightweight they can be easily carried off the ice.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A floor system which comprises:

a sheet of ice comprising an upper ice surface; and a floor assembly disposed on said upper surface, wherein said floor assembly comprises upper and lower floor assembly surfaces, wherein said upper floor assembly surface at last generally projects away from said upper ice surface, wherein said lower floor assembly surface at least generally projects toward said upper ice surface, wherein at least a portion of said lower floor assembly surface contacts said upper ice surface, wherein said lower floor assembly surface comprises a plurality of recesses which define a plurality of spaces between said floor assembly and said sheet of ice, and wherein said floor assembly comprises a rigid material.

2. A system, as claimed in claim 1, wherein:

said floor assembly comprises a plurality of individual floor sections, wherein adjacent floor sections are disposed in abutting engagement.

3. A system, as claimed in claim 2, further comprising:

fasteners which interconnect said adjacent said floor sections.

4. A system, as claimed in claim 1, wherein:

said upper floor assembly surface is at least substantially flat.

5. A system, as claimed in claim 1, wherein:

said floor assembly comprises a thermal insulating material.

6. A system, as claimed in claim 1, wherein:

said floor assembly comprises a rigid polyurethane foam.

7. A system, as claimed in claim 1, wherein:

said floor assembly comprises a material which at least substantially prevents condensation from forming on said upper floor assembly surface.

8. A system, as claimed in claim 1, wherein:

said floor assembly comprises a material which at least substantially prevents coldness from said sheet of ice from penetrating through said floor assembly to said upper floor assembly surface.

9. A system, as claimed in claim 1, wherein:

said plurality of recesses are disposed in spaced relation on said lower floor assembly surface.

10. A system, as claimed in claim 1, wherein:

said plurality of recesses define a waffle-like pattern on said lower floor assembly surface.

11. A system, as claimed in claim 1, wherein:

said floor assembly comprises a first floor section, wherein said lower floor assembly surface of said first floor section comprises a perimeter section and a divider section between, adjacent recesses, wherein contact between said lower floor assembly surface of said first floor section and said upper ice surface is limited to said perimeter section and said divider sections.

12. A system, as claimed in claim 1, wherein:

an amount of area of said lower floor assembly surface which contacts said upper ice surface is small in relation to an area which is covered by said floor assembly.

13. A system, as claimed in claim 1, further comprising:

means for trapping ambient air within each of said plurality of recesses.

14. A system, as claimed in claim 1, further comprising:

means for sealing said lower floor assembly surface about each of said plurality of recesses.

15. A method of assembling a floor system which comprises the steps of:

providing a sheet of ice which comprises an upper ice surface;

disposing a floor assembly on said upper ice surface;

trapping ambient air between said floor assembly and said upper ice surface in a plurality of discrete and spaced recesses, wherein said plurality of recesses are formed in a lower floor assembly surface of said floor assembly; and reducing heat transfer from said sheet of ice through said floor assembly to an upper floor assembly surface, wherein said reducing heat transfer step comprises said trapping step.

16. A method, as claimed in claim 15, further comprising the step of:

reducing a potential for condensation formation on an upper floor assembly surface of said floor assembly.

17. A method, as claimed in claim 16, wherein:

said reducing step comprises said trapping step.

18. A floor system which comprises:

a sheet of ice comprising an upper ice surface; and a floor assembly disposed on said upper ice surface, wherein said floor assembly comprises upper and lower floor assembly surfaces, wherein said upper floor assembly surface at least generally projects away from said upper ice surface, wherein said lower floor assembly surface at least generally projects toward said upper ice surface, wherein at least a portion of said lower floor assembly surface contacts said upper ice surface, wherein said lower floor assembly surface comprises a plurality of recesses which define a plurality of spaces between said floor assembly and is said sheet of ice, and wherein said floor assembly comprises a rigid polyurethane foam.

19. A floor system which comprises:

a sheet of ice comprising an upper ice surface; and a floor assembly disposed on said upper ice surface, wherein said floor assembly comprises upper and lower floor assembly surfaces, wherein said upper floor assembly surface at least generally projects away from said upper ice surface, wherein said lower floor assembly surface at least generally projects toward said upper ice surface, wherein at least a portion of said lower floor assembly surface contacts said upper ice surface, wherein said lower floor assembly surface comprises a plurality of recesses which define a plurality of spaces between said floor assembly and said sheet of ice, wherein said floor assembly comprises a first floor section, wherein said lower floor assembly surface of said first floor section comprises a perimeter section and a divider section between adjacent recesses, and wherein contact between said lower floor assembly surface of said first floor section and said upper ice surface is limited to said perimeter section and said divider sections.

20. A system, as claimed in claim 19, wherein:

said floor assembly comprises a plurality of individual floor sections, wherein adjacent floor sections are disposed in abutting engagement.

21. A system, as claimed in claim 20, further comprising:

fasteners which interconnect said adjacent floor sections.

22. A system, as claimed in claim 19, wherein:

said upper floor assembly surface is at least substantially flat.

23. A system, as claimed in claim 19, wherein:

said floor assembly comprises a rigid material.

24. A system, as claimed in claim 19, wherein:

said floor assembly comprises a thermal insulating material.

25. A system, as claimed in claim 19, wherein:

said floor assembly comprises a rigid polyurethane foam.

26. A system, as claimed in claim 19, wherein:

said floor assembly comprises a material which at least substantially prevents condensation from forming on said upper floor assembly surface.

27. A system, as claimed in claim 19, wherein:

said floor assembly comprises a material which at least substantially prevents coldness from said sheet of ice from penetrating through said floor assembly to said upper floor assembly surface.

28. A system, as claimed in claim 19, wherein:

said plurality of recesses are disposed in spaced relation on said lower floor assembly surface.

29. A system, as claimed in claim 19, wherein:

said plurality of recesses define a waffle-like pattern on said lower floor assembly surface.

30. A system, as claimed in claim 19, wherein:

an amount of area of said lower floor assembly surface which contacts said upper ice surface is small in relation to an area which is covered by said floor assembly.

31. A system, as claimed in claim 19, further comprising:

means for trapping ambient air within each of said plurality of recesses.

32. A system, as claimed in claim 19, further comprising:

means for sealing said lower floor assembly surface about each of said plurality of recesses.

33. A floor system which comprises:

a sheet of ice comprising an upper ice surface; and a floor assembly disposed on said upper ice surface, wherein said floor assembly comprises upper and lower floor assembly surfaces, wherein said upper floor assembly surface at least generally projects away from said upper ice surface, wherein said lower floor assembly surface at least generally projects toward said upper ice surface, wherein at least a portion of said lower floor assembly surface contacts said upper ice surface, wherein said lower floor assembly surface comprises a plurality of recesses which define a plurality of spaces between said floor assembly and said sheet of ice, wherein said floor assembly comprises a plurality of individual floor sections, wherein adjacent floor sections are disposed in abutting engagement, and wherein said floor assembly further comprises fasteners which interconnect said adjacent floor sections.

34. A system, as claimed in claim 33, wherein:

said upper floor assembly surface is at least substantially flat.

35. A system, as claimed in claim 33, wherein.

said floor assembly comprises a rigid material.

36. A system, as claimed in claim 33, wherein:

said floor assembly comprises a thermal insulating material.

37. A system, as claimed in claim 33, wherein:

said floor assembly comprises a rigid polyurethane foam.

38. A system, as claimed in claim 33, wherein:

said floor assembly comprises a material which at least substantially prevents condensation from forming on said upper floor assembly surface.

39. A system, as claimed in claim 33, wherein:

said floor assembly comprises a material which at least substantially prevents coldness from said sheet of ice from penetrating through said floor assembly to said upper floor assembly surface.

40. A system, as claimed in claim 33, wherein:

said plurality of recesses are disposed in spaced relation on said lower floor assembly surface.

41. A system, as claimed in claim 33, wherein:

said plurality of recesses define a waffle-like pattern on said lower floor assembly surface.

42. A system, as claimed in claim 33, wherein:

said lower floor assembly surface of said first floor section comprises a perimeter section and a divider section between adjacent recesses, and wherein contact between said lower floor assembly surface of said first floor section and said upper ice surface is limited to said perimeter section and said divider sections.

43. A system, as claimed in claim 33, wherein:

an amount of area of said lower floor assembly surface which contacts said upper ice surface is small in relation to an area which is covered by said floor assembly.

44. A system, as claimed in claim 33, further comprising:

means for trapping ambient air within each of said plurality of recesses.

45. A system, as claimed in claim 33, further comprising:

means for sealing said lower floor assembly surface about each of said plurality of recesses.

46. A method of assembling a floor system which comprises the steps of:

providing a sheet of ice which comprises an upper ice surface;

disposing a floor assembly on said upper ice surface;

trapping ambient air between said floor assembly and said upper ice surface in a plurality of discrete and spaced recesses, wherein said plurality of recesses are formed in a lower floor assembly of said floor assembly; and reducing a potential for condensation formation on an upper floor assembly surface of said floor assembly, wherein said reducing step comprises said trapping step.

* * * * *